United States Patent [19]

Amberg et al.

[11] 4,102,302

[45] Jul. 25, 1978

[54] ADHESIVE APPLICATOR DEVICE

[75] Inventors: Stephen W. Amberg; John F. Spicer, both of Toledo, Ohio

[73] Assignee: Owens-Illinois, Inc., Toledo, Ohio

[21] Appl. No.: 773,648

[22] Filed: Mar. 2, 1977

[51] Int. Cl.[2] ..... B05C 1/02

[52] U.S. Cl. ..... 118/239; 118/244; 118/262; 118/DIG. 14

[58] Field of Search ..... 118/258, 250, 251, 228, 118/223, DIG. 9, DIG. 14, 262, 239, 244, 261

[56] References Cited

U.S. PATENT DOCUMENTS

| | | | |
|---|---|---|---|
| 1,022,191 | 4/1912 | Graham | 118/DIG. 14 |
| 2,068,141 | 1/1937 | Kramer et al. | 118/262 |
| 2,096,364 | 10/1937 | Smith | 118/262 |
| 3,185,130 | 5/1965 | Pratt | 118/228 |
| 3,348,525 | 10/1967 | Zwarycz et al. | 118/258 X |
| 3,356,068 | 12/1967 | Fritch, Jr. et al. | 118/258 X |
| 3,468,286 | 9/1969 | Nugarus | 118/259 X |

*Primary Examiner*—John P. McIntosh

*Attorney, Agent, or Firm*—John R. Nelson; Myron E. Click; David H. Wilson

[57] ABSTRACT

There is disclosed a device for applying a liquid adhesive onto the surface of bottles moving in upright seriatim fashion on a horizontal moving conveyor at an adhesive applying station. The device includes a container for liquid adhesive and a pivoted frame supported over the container which supports a beveled feed wheel on an inclined shaft driven by its connection to an electric motor. The beveled feed wheel rotates partly submersed in the adhesive and engages a cylindrical applicator roller freely rotatable on a vertical axis at the applying station. The outer periphery of the roller is comprised of a porous, resilient layer, e.g. a spongy urethane layer which receives adhesive from the beveled facing of the feed wheel. The beveled facing of the latter is non-porous and smooth, e.g. a steel facing. The roller is properly loaded with adhesive transferred by the feed wheel and is also driven by the wheel in a direction corresponding with movement of the bottles in the applying station; whereat the roller surface layer engages the bottle surface and applies adhesive thereto.

6 Claims, 2 Drawing Figures

ADHESIVE APPLICATOR DEVICE

The present invention relates to a device for applying liquid adhesive or a like viscous liquid onto the outer surface of a bottle and to apparatus for conveying the bottles in single file during manufacture through an adhesive applying station which includes the device.

BACKGROUND OF THE INVENTION

In the manufacture of labelled bottles a plastic sleeve label that is predecorated and printed is placed over the neck and closure end of a bottle by an automatic machine such as is disclosed in the application of S. W. Amberg, et al., Ser. No. 526,124 filed Nov. 22, 1974 (now U.S. Pat. No. 4,013,496). Obviously, the sleeve is slightly larger in internal diameter than the neck of the bottle. Thereafter, the bottle and sleeve are conveyed together to a heating device whereat the sleeve is heated and shrunken in place snugly onto the bottle. To hold the sleeve in place on the bottle during transfer from the assembly station to the heating device, a spot of adhesive is applied to an area of the bottle surface on the neck prior to applying the sleeve. The sleeve, as it is automatically assembled with the bottle, is pressed against the adhesive which holds the sleeve in place until it is shrunken tightly to the neck. Furthermore, after the label is finished and on the bottle, the adhesive attaches the shrunken label to the neck of the bottle such that upon turning or unscrewing a closure which may also be encircled by the shrunken sleeve, the label is broken annularly near the base of the closure. This provides a means of detecting whether the bottled product has been previously opened or the closure loosened at the time of purchase by the retail customer.

In applying adhesives, a spray nozzle device has been tried, which has caused downtime in the manufacture due to the adhesive clogging the spray nozzle. The clogging of such equipment may also go undetected for a time, resulting in other manufacturing line defects.

SUMMARY OF THE INVENTION

This invention provides a reliably functioning apparatus needed in the aforementioned process which automatically applies a spot of adhesive onto a surface area of the neck of the bottle at a time when the bottle is oriented, timed and entering the automatic machine for assembling the neck label sleeve.

The apparatus is power propelled in the feed of the adhesive, but needs no controls to otherwise operate it; and the adhesive is applied in a reliable manner only upon demand by a bottle's presence in the adhesive applying station along the conveyor carrying bottles to or into the sleeve assembly machine.

The adhesive applying device is constructed to include a container for an adhesive supply or body and a beveled metal wheel partially submerged in the body that is motor driven (rotatably) to pick up the adhesive and transfer it to a freely rotatable applicator roller. The roller includes a surface layer of a porous, resilient material for receiving adhesive and for transferring the proper amount to the bottle upon demand. The device has eliminated the downtime problem and enhanced the reliability and fidelity of the manufacture.

Additionally, the device is constructed such that a pivotally supported frame overlying the adhesive container supports all of the operating parts (feed wheel, roller and drive means), such that the position of the applicator may be easily adjusted and the parts may be pivoted with the frame away from the adhesive body for changing rollers, maintenance or the like.

The adhesive normally utilized is a hot melt thermoplastic adhesive. The device is constructed to include a rigid, non-porous beveled face of the feed wheel and a porous, resilient surface of the applicator roller. This combination transfers adhesive without overloading the roller, and maintains a sufficient supply of adhesive on the roller surface at all times.

There is some firm driving contact or pressure between the beveled face of the feed wheel and the porous resilient surface of the applicator roller. The physical action of the spongy, resilient surface in taking on the adhesive and forcing it out when applied prevents ahhesive build-up and hardening on the roller.

Preferably, the materials selected for these parts include, by way of example, a steel feed wheel having a smooth beveled face thereon and a peripheral annular layer of spongy urethane material on the roller.

DESCRIPTION OF THE INVENTION

Figure 2:
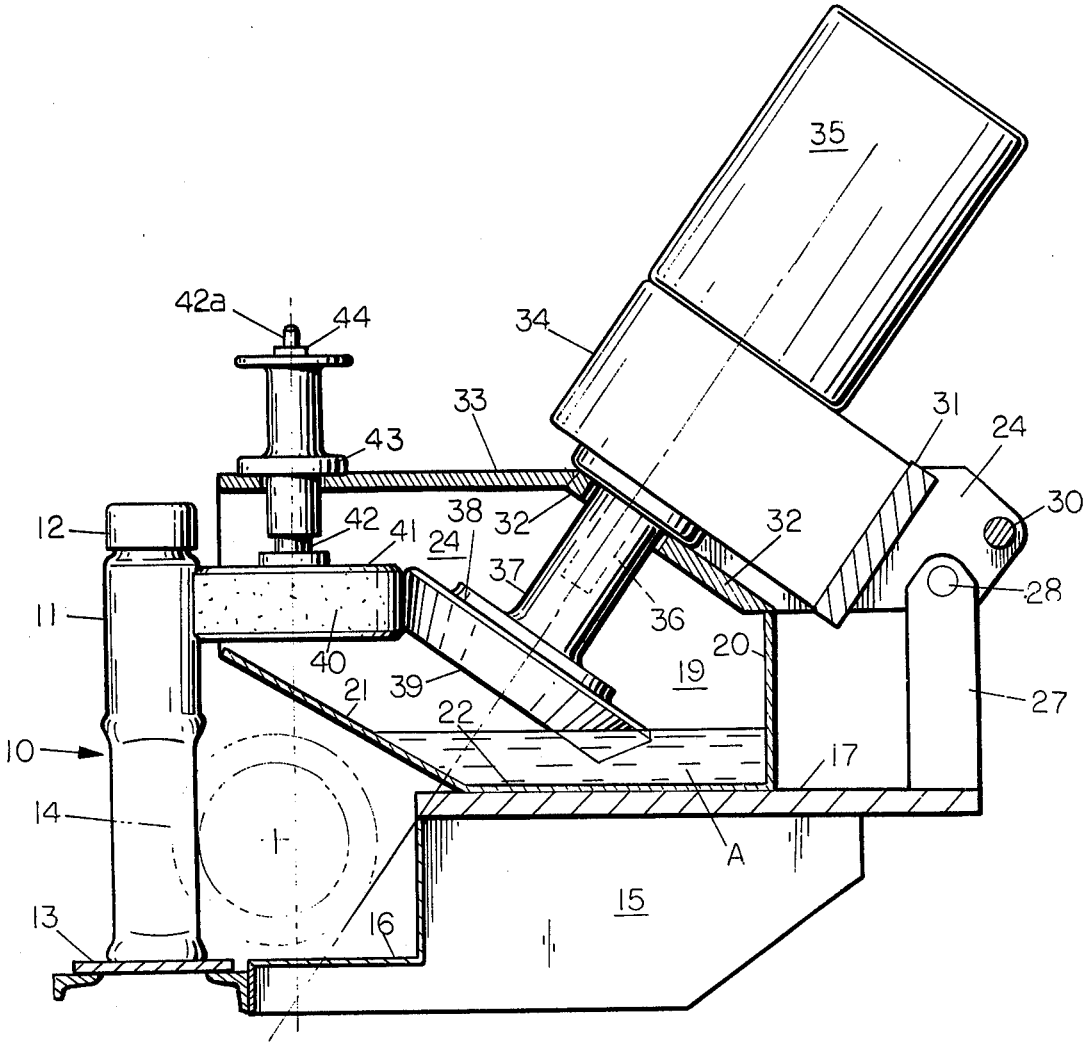
FIG. 2 is a sectional, elevational view of the apparatus shown on FIG. 1.

Referring to the drawings, there is shown an oblong shape of bottle 10 that is sidewise oriented in upright position on a horizontal conveyor 13. Bottle 10 includes an upper, annular neck surface 11 and a screw cap 12 applied over the top of bottle 10 containing bottled product. The bottles 10 (one bottle shown in phantom outline) to be labelled are fed in seriatim on conveyor 13, preferably at properly spaced intervals to be received by the labelling machine, such as is disclosed in the earlier-mentioned application Ser. No. 526,124 (U.S. Pat. No. 4,013,496 ). The bottles are timed or spaced on conveyor 13 by a worm feed screw 14 (shown in phantom outline on FIG. 2). Conveyor 13 will pass an adhesive applying station opposite an adhesive application device, to be presently described. This device is supported on a lateral frame member 15 at the side of conveyor 13 in the adhesive applying station.

Figure 1:
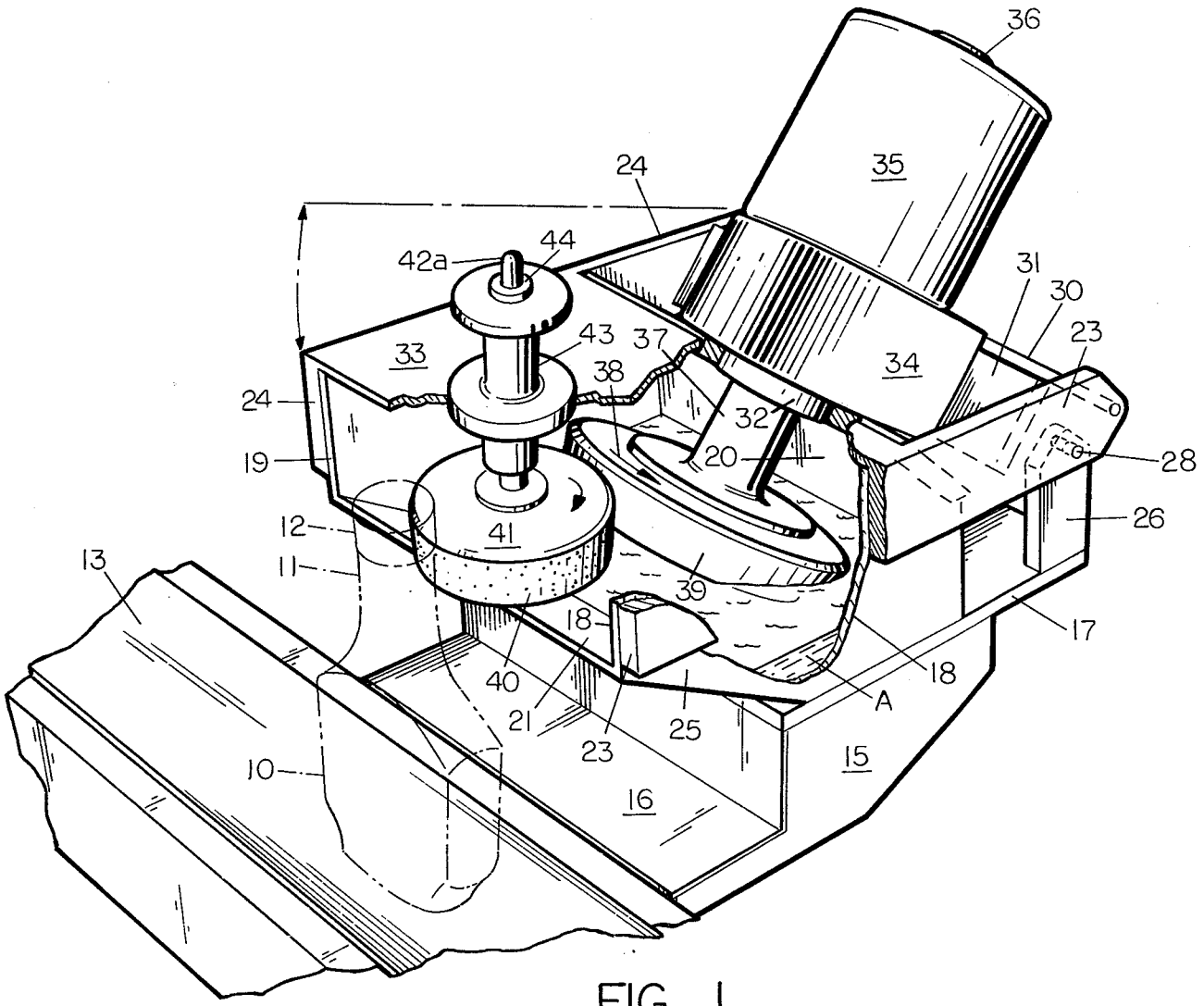
FIG. 1 is a three-quarter side view in perspective of the adhesive applying device mounted in position at an adhesive applying station for treating a surface area of bottles being conveyed past it.

The adhesive application is comprised of a bottom plate or platform 17 suitably fastened on the horizontal top surface 16 of the support member 15. An adhesive container is connected to plate 17 and comprises opposite side walls 18 and 19, a back end wall 20, a bottom wall 22 and a forwardly sloped front wall 21. The sloped wall 21 serves as a drain surface to catch any excess adhesive which may drip from the roller and feed wheel, to be described. A horizontal support means for the operating parts of the device includes the two horizontal side members 23 and 24 each pivotally connected near their one rear end on the vertical posts 26 and 27, respectively, by the pivot pin 28. The members 23 and 24 fit outside the exterior side face 25 of the adhesive container. A transverse rod 30 is supported between the rear ends of members 23 and 24 and serves as a stop member for rotation of the support means about the pivot pins 28, such as when the members rotate clockwise on FIGS. 1 and 2, the rod stops rotation when it engages the posts 26 and 27. A sloped, rear cross member 31 is securely fastened between members 23 and 24, and a forward cross member 32 situated at about a right angle to the rear member 31 provides a support for the shaft housing 34 and electric motor 35. As seen on FIG. 2, the inclined output shaft 36 of motor 35 protrudes through housing 34 and is connected such as by a key and pin (not shown), to the hollow hub shaft 37 of feed wheel 38. The central axis of shaft 36 extends through the center of wheel 38 and is inclined by the cross support members 31, 32 at an angle of about 35° from vertical. Feed wheel 38 is constructed of rigid material, preferably a metal wheel, such as steel, and is provided with beveled surface 39 of non-porous, smooth surface characteristics. The bevel of surface is also about 35° measured from the center axis of wheel 38. The feed wheel surface 39 is rotated by motor 35 through a body of the liquid adhesive material A in the container of the device.

At the forward, top part of the pivotal support means is a horizontal plate 33 fastened to members 23 and 24 which includes an aperture aligned with the axis of shaft 36. A roller surface 40 is provided as a porous, somewhat resilient layer on the peripheral surface of cylindrical applicator roller 41. The roller 41 includes a bearing at its central axis supporting roller 41 on the lower end of a vertical shaft 42 for free rotation of the roller. Shaft 42 extends through the shaft holder 43 and is fastened at the threads 42*a* on its upper end by a retainer nut 44.

The direction of rotation of feed wheel 38 by motor 35 is preferably in a direction which will rotate the roller 41 in a direction corresponding with movement of the bottles 10 by conveyor 13. This relationship of rotation and movement is shown by arrows on FIG. 1; viz, wheel 38 is rotated counter clockwise, roller 41 is rotated by the engaging beveled surface 39 in a clockwise direction and bottle movement is from right to left. The motor is driven at constant speed during operation of the device. Feed wheel 38 is therefore constantly moving its beveled surface 39 through adhesive A and engaging the outer layer 40 of the roller 41 transferring a fresh supply of adhesive to it. Roller 41 is freely rotatable and is driven by wheel 38. There is a pressure between the beveled surface 39 and resilient layer 40 on the roller 41 so that the material at layer 40 is constantly undergoing some squeezing and flexing action. This prevents the adhesive from setting or clogging the roller.

Layer 40 on applicator roller 41 may be constructed of a spongy urethane material, which provides a very good transfer surface for applying adhesive to an area of bottle 10 as it passes through the adhesive applying station.

The adhesive is of course liquid, and adhesive examples include a thermoplastic hot melt composition, solvent based adhesive or water based adhesive. The amount of compression force exerted by the bevel surface 39 against the roller spongy layer 40 will determine the wetness of the roller and the quantity of glue applied for a given viscosity and type of adhesive. While running, the unit is self-cleaning by the compression and relation of the spongy surface on the solid bevel rim of the transfer wheel.

Having disclosed a preferred example of the invention, it should be understood that further modifications and embodiments which may occur to those skilled in the art are to be included within the scope of the invention as hereinafter defined in the claims.

What is claimed is:

1. The combination comprising a horizontal power driven conveyor span supporting a plurality of bottles in vertical upright position in a spaced apart series for movement in a single file succession past an adhesive applying station, a lateral frame at said applying station, an adhesive application device supported on said frame comprising a container for a body of liquid adhesive supported on said frame, a generally horizontal support means pivotally connected to said frame overlying said adhesive body in said container and rotatable between an active adhesive applying position and a rotated remote position, a feed wheel including a beveled outer peripheral surface, a shaft connected to said wheel for rotation of the latter about its central axis, said shaft being supported in a vertically inclined position on said horizontal support means, said feed wheel being similarly inclined in adhesive applying position for rotation of a portion of its peripheral surface in the adhesive body, a motor drive means mounted on said support means and connected to rotate said shaft, an applicator roller including a substantially cylindrical outer peripheral surface and a central vertical shaft supporting said roller for free rotation, said vertical shaft being rotably supported on said horizontal support means, and a support for said vertical roller shaft connected to said overlapping pivotal horizontal support means to maintain the peripheral surface of said roller in running engagement with the beveled surface of the feed wheel and engageable while in the active adhesive applying position with the exterior surface of bottles at the adhesive applying station.

2. The combination of claim 1 wherein the horizontal support means of the adhesive application device comprises a pair of parallel, generally horizontally disposed cantilever members disposed on either side of the adhesive container, an inclined cross member supporting said motor and a forward cross member supporting said vertical roller shaft, said cross members each being connected to the pair of cantilever members, and a pivotal support on the frame for each of said cantilever members adjacent the rearmost portion thereof away from the adhesive applying station, whereby said horizontal support means is rotatable as a unit from said active adhesive applying position to a remote position laterally away from said station.

3. The combination of claim 2 in which the motor drive means comprises an electric motor, said motor being operated in a direction of rotation to drive the applicator roll in the direction of rotation that is in the direction of movement of the bottles at the time of engagement therewith.

4. The combination of claim 1 in which the outer beveled surface of the feed wheel is comprised of a non-porous, rigid material and the peripheral surface of said applicator roller is comprised of a porous, resilient material.

5. The combination of claim 4 in which said porous, resilient material comprises a spongy urethane.

6. The combination of claim 5 in which said beveled surface of the feed wheel comprises a smooth steel surface.

* * * * *